US006513588B1

(12) United States Patent
Metcalfe

(10) Patent No.: US 6,513,588 B1
(45) Date of Patent: Feb. 4, 2003

(54) DOWNHOLE APPARATUS

(75) Inventor: Paul David Metcalfe, Peterculter (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/660,774

(22) Filed: Sep. 13, 2000

(30) Foreign Application Priority Data

Sep. 14, 1999 (GB) ..... 9921557

(51) Int. Cl.[7] ..... E21B 19/00

(52) U.S. Cl. ..... 166/89.2; 166/91.1; 166/242.2; 166/242.3

(58) Field of Search ..... 166/77.2, 89.1, 166/89.2, 91.1, 75.12, 97.5, 242.1–242.3

(56) References Cited

U.S. PATENT DOCUMENTS

| | | | | |
|---|---|---|---|---|
| 988,054 | A | 3/1911 | Wiet | |
| 1,301,285 | A | 4/1919 | Leonard | |
| 1,880,218 | A | 10/1932 | Simmons | |
| 1,981,525 | A | 11/1934 | Price | |
| 2,017,451 | A | 10/1935 | Wickersham | |
| 2,214,226 | A | 9/1940 | English | |
| 2,383,214 | A | 8/1945 | Prout | 153/82 |
| 2,424,878 | A | 7/1947 | Crook | 154/82 |
| 2,499,630 | A | 3/1950 | Clark | 153/81 |
| 2,519,116 | A | 8/1950 | Crake | |
| 2,627,891 | A | 2/1953 | Clark | 153/82 |
| 2,633,374 | A | 3/1953 | Boice | 285/118 |
| 3,028,915 | A | 4/1962 | Jennings | |
| 3,039,530 | A | 6/1962 | Condra | 166/55 |
| 3,167,122 | A | 1/1965 | Lang | |

(List continued on next page.)

FOREIGN PATENT DOCUMENTS

| | | | |
|---|---|---|---|
| DE | 3213464 A1 | 10/1983 | B23D/45/12 |
| DE | 4133802 C1 | 10/1991 | F16L/9/12 |
| EP | 0 937 861 | 8/1999 | E21B/43/10 |
| EP | 0952305 A1 | 10/1999 | E21B/43/10 |
| FR | 721 430 | 3/1932 | |
| FR | 2 326 229 | 4/1977 | B01J/3/02 |
| GB | 730338 | 5/1955 | |
| GB | 792886 | 4/1958 | |
| GB | 997721 | 7/1965 | |
| GB | 1277461 | 6/1972 | B21D/39/04 |
| GB | 1448304 | 9/1976 | E21B/33/13 |
| GB | 1457843 | 12/1976 | B21D/39/10 |
| GB | 1582392 | 1/1981 | B21D/39/10 |
| GB | 2216926 A | 10/1989 | E21B/7/20 |
| GB | 2313860 B | 10/1997 | E21B/10/34 |

(List continued on next page.)

OTHER PUBLICATIONS

PCT International Search Report from PCT/GB 00/03531, Dated Nov. 24, 2000.

PCT Written Opinion from PCT/GB 00/03531, Dated Oct. 9, 2001.

PCT International Preliminary Examination Report from PCT/GB 00/03531, Dated Dec. 11, 2001.

"Expandable Slotted Tubes Offer Well Design Benefits", Metcalfe, P., Petroline Wireline Services Ltd., Hart's Petroleum Engineer International, Oct. 1996, pp. 60–63.

*Primary Examiner*—Roger Schoeppel

(74) *Attorney, Agent, or Firm*—Moser, Patterson & Sheridan, L.L.P.

(57) ABSTRACT

Expandable tubing (20) has a tubing wall (22) comprising a plurality of deformable tubular structures (24). The structures (24) have permeable walls and containing a filter medium (28) such that fluid may flow through the structures (24) and the filter medium (28) and thus through the tubing wall (22).

32 Claims, 3 Drawing Sheets

U.S. PATENT DOCUMENTS

| | | | | | |
|---|---|---|---|---|---|
| 3,179,168 | A | | 4/1965 | Vincent | |
| 3,186,485 | A | | 6/1965 | Owen | 166/63 |
| 3,191,677 | A | | 6/1965 | Kinley | |
| 3,191,680 | A | | 6/1965 | Vincent | |
| 3,203,451 | A | | 8/1965 | Vincent | 138/143 |
| 3,203,483 | A | | 8/1965 | Vincent | 166/207 |
| 3,245,471 | A | | 4/1966 | Howard | |
| 3,297,092 | A | | 1/1967 | Jennings | 166/207 |
| 3,326,293 | A | | 6/1967 | Skipper | 166/150 |
| 3,353,599 | A | | 11/1967 | Swift | |
| 3,354,955 | A | | 11/1967 | Berry | |
| 3,477,506 | A | | 11/1969 | Malone | 166/207 |
| 3,489,220 | A | | 1/1970 | Kinley | 166/277 |
| 3,583,200 | A | | 6/1971 | Cvijanovic et al. | 72/393 |
| 3,669,190 | A | | 6/1972 | Sizer et al. | 166/315 |
| 3,689,113 | A | | 9/1972 | Blaschke | 285/90 |
| 3,691,624 | A | | 9/1972 | Kinley | 29/523 |
| 3,712,376 | A | | 1/1973 | Owen et al. | 166/277 |
| 3,746,091 | A | | 7/1973 | Owen et al. | 166/207 |
| 3,776,307 | A | | 12/1973 | Young | 166/125 |
| 3,780,562 | A | | 12/1973 | Kinley | 72/479 |
| 3,785,193 | A | | 1/1974 | Kinley et al. | 72/393 |
| 3,820,370 | A | | 6/1974 | Duffy | 72/75 |
| 3,948,321 | A | | 4/1976 | Owen et al. | 166/277 |
| 3,977,076 | A | | 8/1976 | Vieira et al. | 30/103 |
| 3,982,724 | A | * | 9/1976 | Citrin | |
| 4,216,802 | A | * | 8/1980 | Bonnes et al. | |
| 4,319,393 | A | | 3/1982 | Pogonowski | 29/434 |
| 4,349,050 | A | | 9/1982 | Bergstrom et al. | 138/147 |
| 4,359,889 | A | | 11/1982 | Kelly | 72/62 |
| 4,362,324 | A | | 12/1982 | Kelly | 285/119 |
| 4,382,379 | A | | 5/1983 | Kelly | 73/46 |
| 4,387,502 | A | | 6/1983 | Dom | 29/568 |
| 4,407,150 | A | | 10/1983 | Kelly | 72/61 |
| 4,414,739 | A | | 11/1983 | Kelly | 29/727 |
| 4,445,201 | A | | 4/1984 | Pricer | 365/154 |
| 4,450,612 | A | | 5/1984 | Kelly | 72/62 |
| 4,470,280 | A | | 9/1984 | Kelly | 72/61 |
| 4,483,399 | A | | 11/1984 | Colgate | 166/308 |
| 4,487,630 | A | | 12/1984 | Crook et al. | 75/123 B |
| 4,502,308 | A | | 3/1985 | Kelly | 72/58 |
| 4,505,142 | A | | 3/1985 | Kelly | 72/54 |
| 4,505,612 | A | | 3/1985 | Shelly, Jr. | 405/101 |
| 4,567,631 | A | | 2/1986 | Kelly | 29/157.3 C |
| 4,581,617 | A | | 4/1986 | Yoshimoto et al. | 346/108 |
| 4,626,129 | A | | 12/1986 | Kothmann et al. | 405/43 |
| 4,773,451 | A | * | 9/1988 | Hegler et al. | |
| 4,807,704 | A | | 2/1989 | Hsu et al. | 166/313 |
| 4,866,966 | A | | 9/1989 | Hagen | 72/75 |
| 4,883,121 | A | | 11/1989 | Zwart | 166/217 |
| 4,976,322 | A | | 12/1990 | Abdrakhmanov et al. | 175/57 |
| 4,997,320 | A | | 3/1991 | Hwang | 408/22 |
| 5,014,779 | A | | 5/1991 | Meling et al. | 166/55.7 |
| 5,052,483 | A | | 10/1991 | Hudson | 166/55 |
| 5,052,849 | A | | 10/1991 | Zwart | 403/300 |
| 5,156,209 | A | | 10/1992 | McHardy | 166/324 |
| 5,267,613 | A | | 12/1993 | Zwart et al. | 166/178 |
| 5,271,472 | A | | 12/1993 | Leturno | 175/107 |
| 5,301,760 | A | | 4/1994 | Graham | 175/61 |
| 5,307,879 | A | | 5/1994 | Kent | 166/382 |
| 5,322,127 | A | | 6/1994 | McNair et al. | 166/313 |
| 5,348,095 | A | | 9/1994 | Worrall et al. | 166/380 |
| 5,366,012 | A | | 11/1994 | Lohbeck | 166/277 |
| 5,409,059 | A | | 4/1995 | McHardy | 166/208 |
| 5,472,057 | A | | 12/1995 | Winfree | 175/57 |
| 5,497,620 | A | * | 3/1996 | Stobbe | |
| 5,520,255 | A | | 5/1996 | Barr et al. | 175/24 |
| 5,553,679 | A | | 9/1996 | Thorp | 175/73 |
| 5,560,426 | A | | 10/1996 | Trahan et al. | 166/120 |
| 5,636,661 | A | | 6/1997 | Moyes | 137/614.2 |
| 5,667,011 | A | | 9/1997 | Gill et al. | 166/295 |
| 5,706,905 | A | | 1/1998 | Barr | 175/61 |
| 5,785,120 | A | | 7/1998 | Smalley et al. | 166/55 |
| 5,887,668 | A | | 3/1999 | Haugen et al. | 175/79 |
| 5,901,789 | A | | 5/1999 | Donnelly et al. | 166/381 |
| 5,924,745 | A | | 7/1999 | Campbell | 285/90 |
| 5,960,895 | A | | 10/1999 | Chevallier et al. | 175/27 |
| 5,979,571 | A | | 11/1999 | Scott et al. | 175/61 |
| 6,029,748 | A | | 2/2000 | Forsyth et al. | 166/380 |
| 6,070,671 | A | | 6/2000 | Cumming et al. | 166/381 |

FOREIGN PATENT DOCUMENTS

| | | | |
|---|---|---|---|
| GB | 2329918 A | 4/1999 | E21B/43/10 |
| WO | WO 92/01139 | 1/1992 | E21B/17/08 |
| WO | WO 93/24728 | 12/1993 | E21B/17/10 |
| WO | WO 93/25800 | 12/1993 | E21B/43/10 |
| WO | WO 94/25655 | 11/1994 | D04C/1/06 |
| WO | WO 97/21901 | 6/1997 | E21B/17/08 |
| WO | WO 98/00626 | 1/1998 | E21B/43/10 |
| WO | WO 99/02818 | 1/1999 | E21B/43/10 |
| WO | WO 99/18328 | 4/1999 | E21B/23/01 |
| WO | WO 99/23354 | 5/1999 | E21B/43/10 |

* cited by examiner

DOWNHOLE APPARATUS

This invention relates to a downhole apparatus, and in particular but not exclusively to forms of expandable tubing and to forms of expandable filters and filter supports.

WO93/25800 (Shell Internationale Research Maatschappij B.V.) described a method of completing an uncased section of borehole. A slotted liner provided with overlapping longitudinal slots is fixed in the borehole and a tapering expansion mandrel is pushed or pulled through the liner. The liner is expanded by the mandrel to support the adjacent borehole wall.

WO97/17524 (Shell Internationale Research Maatschappij B.V.) describes a deformable well screen and method for its installation utilising two sections of concentric slotted tubing, such as described in WO 93/25800, with a series of circumferentially scaled filter segments therebetween. The screen is expanded by pushing or pulling an expansion mandrel through the screen.

The expansion mechanism of these arrangements is such that there is an axial retraction of the tubing on radial expansion. This not only creates difficulties in accurately locating and securing the ends of the tubing in a bore relative to adjacent tubing sections, but also may result in undesirable relative axial movement between the tubing and other elements mounted thereon, such as filter segments. Further, in such a filter arrangement, the radial expansion forces which must be applied to the outer section of expandable tubing are transferred via the filter medium or media located between the tubing sections; this limits the range of media which may be utilised in such arrangements to filter materials and configurations which will withstand significant compressive forces, in addition to the significant shear forces which the filter material will experience during expansion of the tubing sections.

It is among the objectives of embodiments of aspects of the invention to provide alternative expandable tubing forms, including expandable filters and filter supports, which overcome such disadvantages.

According to the present invention there is provided expandable tubing having a tubing wall comprising a plurality of deformable tubular structures, at least some of the structures having permeable walls and containing a filter medium such that fluid may flow through the structures and thus through the tubing wall.

This aspect of the invention is useful as a downhole filter or sand screen, the deformable tubular structures forming the wall of the tubing facilitating expansion of the tubing, and the tubular structures potentially serving as filter elements and also accommodating a selected filter medium or media. Also, the use of the tubular structures to accommodate or facilitate expansion assists in avoiding the longitudinal contraction which tends to occur on radial expansion of tubing defining overlapping longitudinally extending slots.

The tubular structures may extend longitudinally, helically, or in be positioned in any appropriate orientation. A substantially axial orientation may offer more straightforward assembly and resistance to bending, however for other applications a helical arrangement may offer greater flexibility and resistance to radial compressive forces.

The tubular structures may be of any material, structure or form which provides the desired degree of deformability, permeability and the desired degree of structural strength. In one embodiment, the tubular structures are of sintered ductile metal, while in other embodiments drilled or slotted tubes may be utilised. If sintered metal, or some other porous material of similar structure, is utilised to form the tubular structures, the pores of the material may be initially filled or occupied by another material to create an impermeable structure. This filling material may be subsequently removed, for example by application of an appropriate solvent, which may be produced fluid, or exposure to elevated temperature as experienced in deeper bores.

The tubular structures may be connected to one another by any appropriate method, for example metal structures may be welded or brazed to one another, or the structures may be retained between two expandable sleeves or tubes.

In other embodiments, the tubular structures may be defined by appropriately shaped sheets or elements, or unitary structures, for example two corrugated sheets or tubes which have been welded or otherwise secured together, or by extruding or otherwise forming the tubing wall in a form which incorporates tubular structures. These embodiments may form other aspects of the invention, in which the tubular structures are impermeable, that is fluid is prevented from flowing through the tubing wall, in one or both of the unexpanded and expanded configurations.

The tubular structures may feature substantially continuous walls, or may have discontinuities therein, for example the tubular structures may be substantially C-shaped.

The tubular structures may accommodate a filter medium of media, such as woven wire, porous foam, wire mesh or wire wool, or indeed any medium presently utilised as a filter and which could be located within a tubular structure and withstand the change in shape experienced by the tubular structures during expansion. Alternatively or in addition, the tubular structures may be lined with a filter media in the form of a flexible or deformable porous material.

The aperture or pore size defined by the tubular structures or the filter media therein may be selected as appropriate, depending on the intended application of the tubing: the tubing may provide a relatively coarse filter, for preventing passage of relatively large solids, or may be such that passage of liquid or very fine solids is prevented or restricted, and only passage of gas is permitted, by use of a tubular structure-lining material such an expanded PTFE, as produced under the Gore-Tex trade mark by W. L. Gore & Associates.

These and other aspects of the present invention will now be described, by way of example, with reference to the accompanying drawings, in which.

Figure 1:
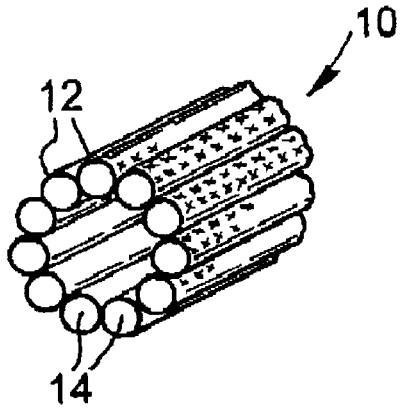
FIG. 1 is a diagrammatic representation of an expandable tubing in accordance with an aspect of the present invention.
Figure 2:
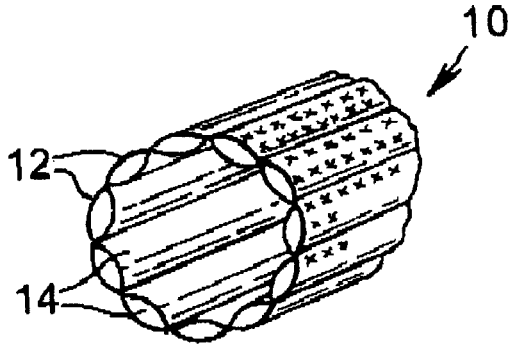
FIG. 2 shows the tubing of FIG. 1 following expansion.

Reference is first made to FIGS. 1 and 2 of the drawings, which illustrate a form of expandable tubing 10, in accordance with an aspect of the present invention, and which may be utilised as or as part of a sand screen or other downhole filter arrangement. Typically, the tubing will be run into a bore in the "unexpanded" form as illustrated in FIG. 1, anchored in the bore, and then expanded to the larger diameter expanded form as illustrated in FIG. 2, with a degree of expansion in excess of 30% being achievable.

The tubing wall 12 comprises a plurality of axially extending tubular structures in the form of small diameter tubes 14 formed of sintered metal. The tubes 14 provide a porous sand filtering media.

Expansion of the tubing 10 is primarily accommodated by a flattening of the tubes 14, and the expanded tubing is shown in FIG. 2 of the drawings. This expansion may be achieved by means of a conventional expanding cone or mandrel, which is pushed or pulled through the tubing 10. As the tubes 14 deform there will also be some deformation and variation in the sizes of the pores, apertures and passages in the walls of the tubes, however pore size variation may be predicted to some extent, and in any event it is difficult to form a porous sintered metal product with closely controlled pore size.

Figure 3:
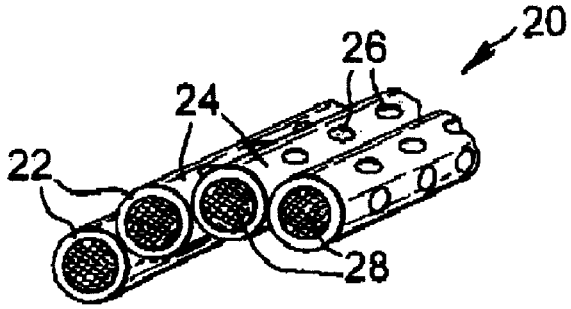
FIG. 3 is a diagrammatic representation of part of a wall of an expandable tubing in accordance with a further aspect of the present invention.
Figure 4:
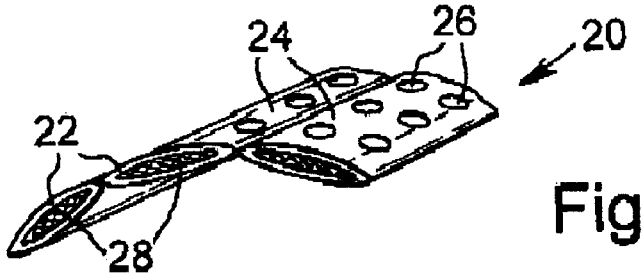
FIG. 4 shows the tubing of FIG. 3 following expansion.

Reference is now made to FIGS. 3 and 4 of the drawings, which illustrate part of an alternative expandable tubing 20, in which the tubing wall 22 comprises a plurality of solid tubes 24 having holes 26 drilled therein. The tubes 24 accommodate filter media 28 which may be in the form of deformable woven wire, porous foam, wire mesh or wire wool. On expansion of the tubing, to the form illustrated in FIG. 4, the aperture or pore size of the filter media 28 will not tend to change (although the filter media may be subject to some compaction), providing a greater degree of predictability than the tubing 10 described above.

Figure 5:
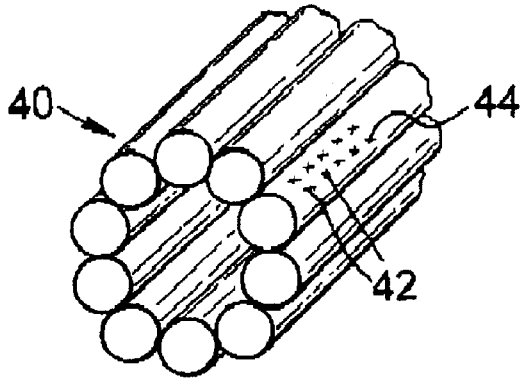
FIG. 5 illustrates an expandable tubing in accordance with a still further aspect of the present invention.

Reference is now made to FIG. 5 which illustrates a similar form of expandable tubing 40 to that shown in FIG. 1, except that the pores 42 of the material forming the tube walls are initially filled by another removable material 44 thus (temporarily) creating an impermeable structure. This filling material 44 may be subsequently dissolved, or removed by exposure to elevated temperatures.

Figure 6:
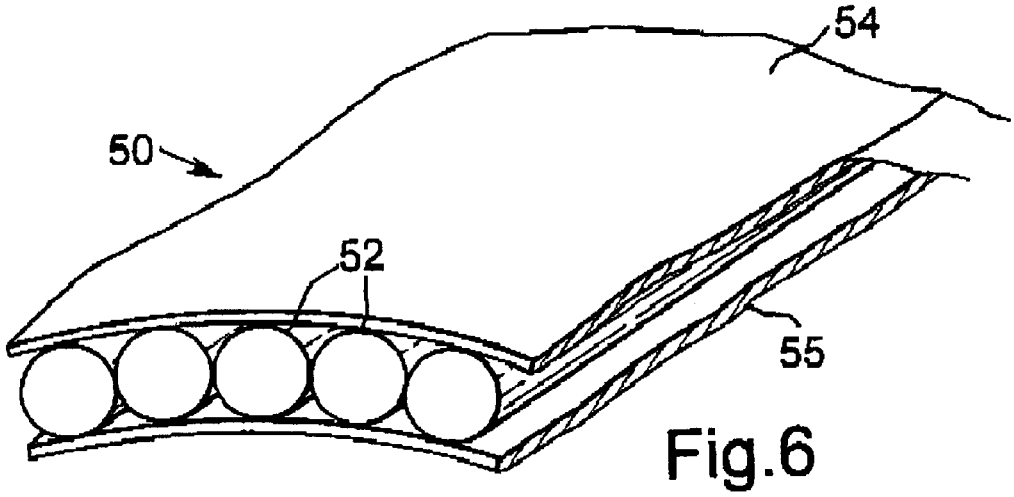
FIGS. 6 to 9 are diagrammatic representations of walls of expandable tubings in accordance with further aspects of the present invention.

FIG. 6 illustrates a further alternative embodiment of the present invention in which the tubular structures 52 are retained between two expandable sleeves 54, 55

Figure 7:
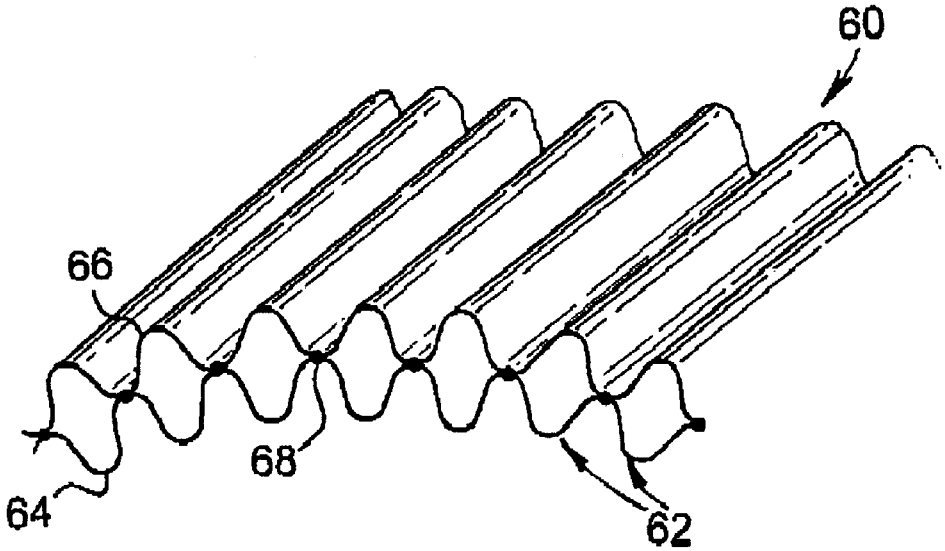

FIG. 7 illustrates a wall section 60 of tubing 60 of a further embodiment of the present invention wherein the tubular structures 62 are defined by inner and outer corrugated sheets 64, 66. These sheets 64, 66 are welded together at 68.

Figure 8:
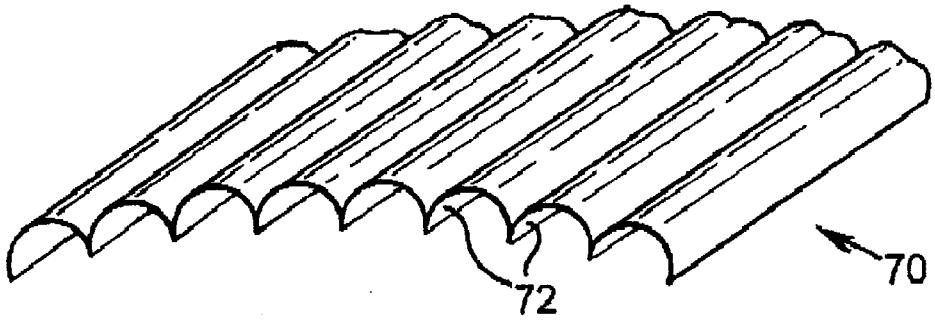

Reference is now made to FIG. 8, which shows a wall section of tubing 70 of another embodiment of the invention, which tubing features an alternative form of tubular structures 72 to define the bounding walls of the expandable tubing 70. In this particular example, the tubular structures 72 do not have continuous walls, being substantially C-shaped.

Figure 9:
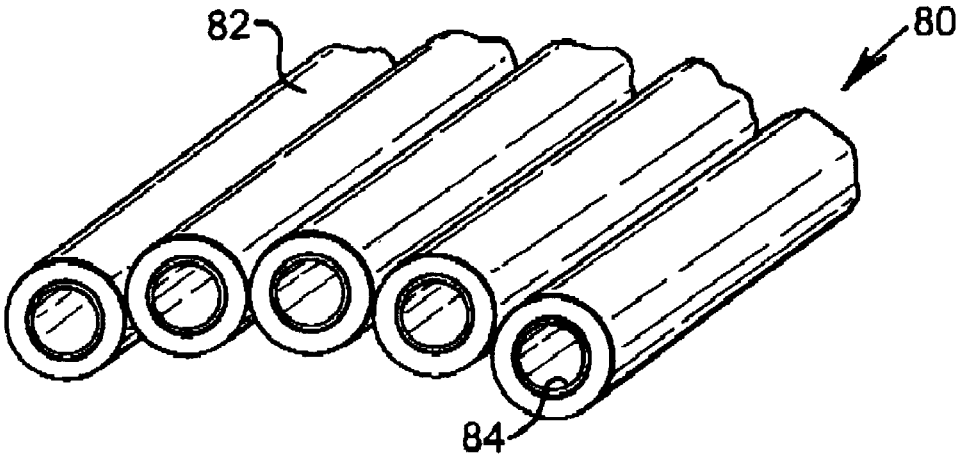

FIG. 9 illustrates a wall section of tubing 80 of a further embodiment of the invention. In this embodiment, the porous tubular structures 82 are lined with a filter membrane 84. In this example the membrane 84 is a flexible porous material, in particular expanded PTFE, as sold under the GORE-TEX trade mark, and is impervious to selected liquids, and only permits passage of gas therethrough.

It will be apparent to those of the skill in the art that the above-described embodiments are merely exemplary of the various aspects of the present invention, and that various modifications and improvements may be made thereto without departing from the scope of the present invention.

What is claimed is:

1. Expandable tubing having a tubing wall comprising a plurality of deformable tubular structures, at least some of the structures having permeable walls such that fluid may flow through the structures, whereby upon a radial force applied to an interior of the tubing, an inside and outside diameter of the tubing is permanently enlarged.

2. The tubing of claim 1, wherein the tubular structures are arranged such that fluid may flow through the structures and be filtered by the structures.

3. The tubing of claim 2, wherein an interior of the tubular structures is lined with a filter medium.

4. The tubing of claim 3, wherein the filter medium is a flexible porous material.

5. The tubing of claim 4, wherein the flexible porous material is a membrane adapted to prevent passage of selected liquids and permit passage of gas therethrough.

6. Expandable tubing having a tubing wall comprising a plurality of deformable tubular structures, at least some of the structures having permeable walls such that fluid may flow through and be filtered by the structures, whereby upon a radial force applied to an interior of the tubing, the wall is expandable past an elastic limit.

7. The tubing of claim 6, wherein the tubing is adapted to prevent flow of particulates through the tubing wall.

8. The tubing of claim 6, wherein the tubular structures are arranged longitudinally.

9. The tubing of claim 6, wherein the tubular structures are formed at least partially of a sintered ductile metal.

10. The tubing of claim 6, wherein the permeable walls of the structures are initially filled with a removable material to create initially impermeable structures, whereby upon removal of the removable material, fluid may flow through the structures.

11. The tubing of claim 6, wherein the tubular structures include a plurality of apertures and contain a filter media.

12. The tubing of claim 6, wherein the tubular structures are retained between expandable permeable sleeves.

13. The tubing of claim 6, wherein the tubular structures are formed from corrugated members.

14. The tubing of claim 6, wherein the tubular structures have substantially continuous walls therearound.

15. The tubing of claim 6, wherein the tubular structures have noncontinuous C-shaped walls.

16. The tubing of claim 6, wherein an interior of the tubular structures is lined with a filter medium.

17. The tubing of claim 16, wherein the filter medium is a flexible porous material.

18. The tubing of claim 17, wherein the flexible porous material is adapted to prevent passage of selected liquids therethrough but to permit passage of gas therethrough.

19. Expandable tubing having a tubing wall comprising a plurality of deformable tubular structures, at least some of the structures having porous walls, wherein fluid may flow therethrough and be filtered by the structures, whereby upon a radial force applied to an interior of the tubing, an inside and outside diameter of the tubing is permanently enlarged.

20. The tubing of claim 19, wherein the tubular structures are formed from corrugated members.

21. The tubing of claim 19, wherein the tubular structures are retained between expandable permeable sleeves.

22. The tubing of claim 19, wherein the tubular structures have noncontinuous C-shaped walls.

23. The tubing of claim 19, wherein the tubing is adapted to prevent flow of particulates through the tubing wall.

24. The tubing of claim 19, wherein the tubular structures are arranged longitudinally.

25. The tubing of claim 19, wherein the tubular structures are formed from sintered ductile metal.

26. Expandable tubing having a tubing wall comprising a plurality of deformable tubular structures, at least some of the structures having permeable walls such that fluid may flow through and be filtered by the structures, wherein the tubular structures are formed from corrugated members.

27. The tubing of claim 26, wherein the tubular structures include a plurality of apertures and contain a filter media.

28. The tubing of claim 26, wherein the tubular structures are retained between expandable permeable sleeves.

29. The tubing of claim 26, wherein the tubular structures have noncontinuous C-shaped walls.

30. Expandable tubing having a tubing wall comprising a plurality of deformable tubular structures, at least some of the structures having porous walls, wherein fluid may flow therethrough and be filtered by the structures, wherein the tubular structures are retained between expandable permeable sleeves.

31. The tubing of claim 30, wherein the tubular structures are formed from corrugated members.

32. The tubing of claim 30, wherein the tubular structures have noncontinuous C-shaped walls.

* * * * *